United States Patent [19]

Russell

[11] 4,407,377

[45] Oct. 4, 1983

[54] SURFACE CONTROLLED BLADE STABILIZER

[76] Inventor: Larry R. Russell, 6025 Edgemor, Suite C, Houston, Tex. 77081

[21] Appl. No.: 368,996

[22] Filed: Apr. 16, 1982

[51] Int. Cl.[3] ..... E21B 7/00; E21B 17/00; E21B 34/10

[52] U.S. Cl. ..... 175/325; 166/321; 166/332; 166/374

[58] Field of Search ..... 175/325; 166/240, 241, 166/319, 321, 332, 370, 374, 386; 137/494; 308/4 A

[56] References Cited

U.S. PATENT DOCUMENTS

| | | | |
|---|---|---|---|
| Re. 25,471 | 11/1963 | Fredd | 166/321 X |
| 3,370,657 | 2/1968 | Antle | 175/325 |
| 3,675,718 | 7/1972 | Kanady | 166/319 X |
| 3,703,104 | 11/1972 | Tamplen | 166/240 X |
| 3,986,554 | 10/1976 | Nutter | 166/319 |
| 4,071,101 | 1/1978 | Ford | 175/325 |
| 4,135,577 | 1/1979 | Nelson et al. | 175/325 X |
| 4,258,804 | 3/1981 | Richey et al. | 175/325 |

*Primary Examiner*—Stephen J. Novosad
*Assistant Examiner*—Thuy M. Bui
*Attorney, Agent, or Firm*—Carl B. Fox, Jr.

[57] ABSTRACT

Drill string stabilizer apparatus, controllable to expand and retract entirely from the surface by control of drill string pressure, wherein increase of drill string pressure from the surface closes a valve to create a piston means which is moved down by drill string pressure to expand the stabilizer blades, said valve being opened and the piston moving upward upon reduction of drill string pressure to retract the stabilizer blades. Upward and downward movements of the piston and an actuator sleeve therebelow are controlled by a barrel cam acting between the housing and the actuator sleeve.

12 Claims, 10 Drawing Figures

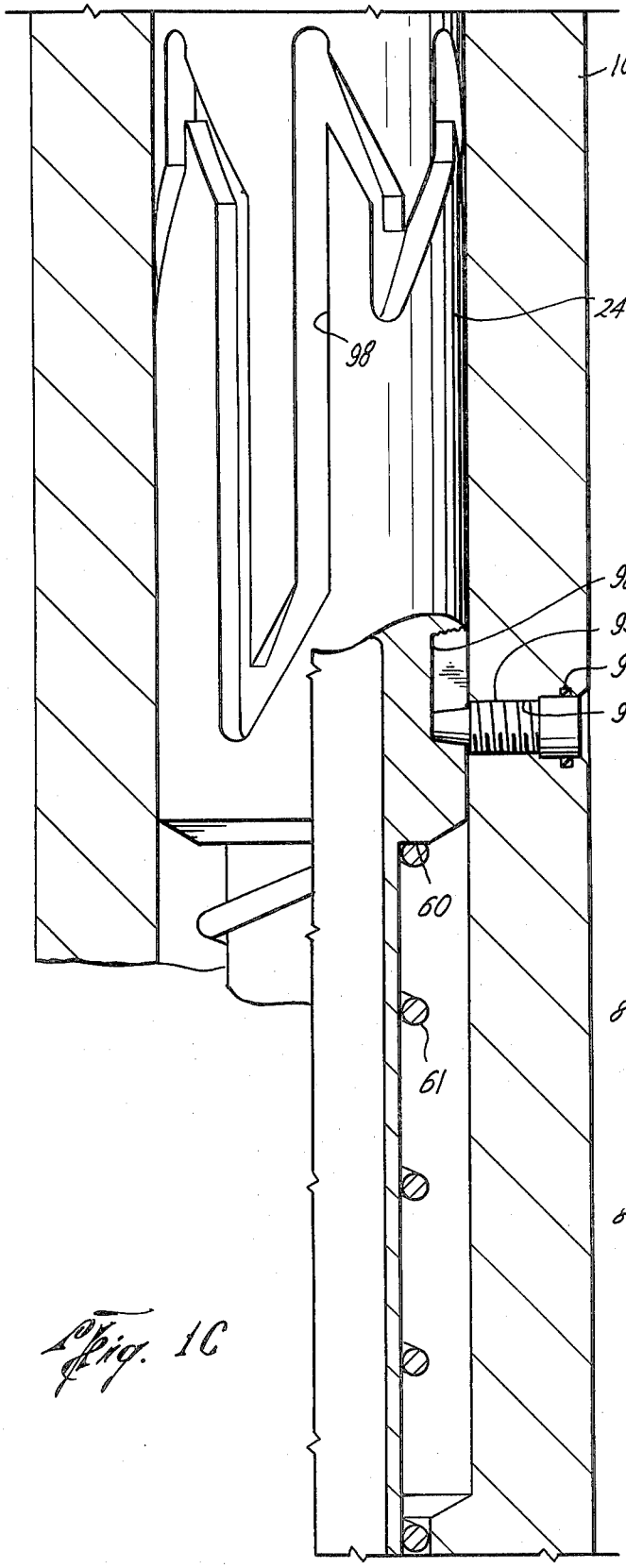
Fig. 1C
Fig. 1D
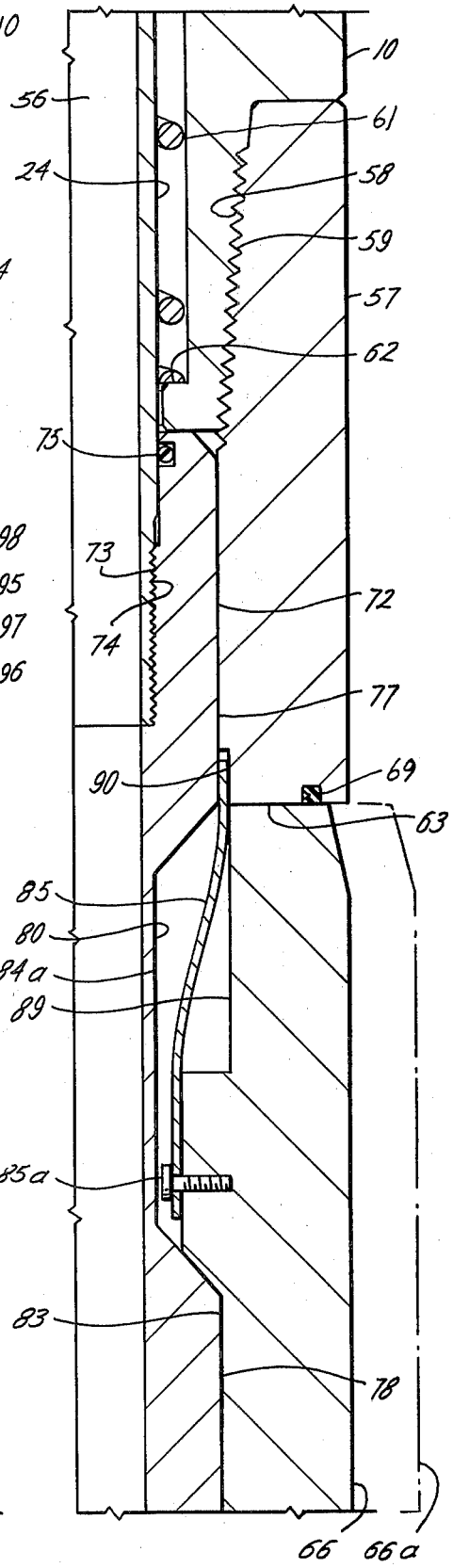

SURFACE CONTROLLED BLADE STABILIZER

The Government has rights in this invention pursuant to Contract No. DE-AC19-80BC10175.

BACKGROUND OF THE DISCLOSURE

Most blade stabilizers used in the drilling of petroleum wells are of fixed design, not subject to being controlled from the surface of the well. Stabilizers are incorporated in the drill string and serve to centralize the drill string in the well hole and to stabilize it against motions away from the well hole axis. The stabilizers are usually placed in the drill string at some depth below the surface, it being necessary to withdraw the drill string from the well hole to install or relocate the stabilizers. This invention seeks to provide stabilizer apparatus which may be run into a well as part of the drill string and expanded and/or retracted to perform its stabilizer function when desired at a later time, and which may be repeatedly expanded and retracted as often as may be desired.

SUMMARY OF THE INVENTION

The stabilizer apparatus according to the invention includes a longitudinal tubular blade housing having plural stabilizer blades disposed in longitudinal wall slots thereof. The stabilizer blades are expanded when desired by downward movement of an expanding sleeve which has exterior lands slidable to engage corresponding interior lands of the stabilizer blades to force them outward. Movement of the expander sleeve is provided by closing a valve at the upper end of the expander sleeve by means of an increased drill string pressure, following which continued or further increased drill string pressure is used to drive the closed valve downwardly, thereby moving the expander sleeve downward to cause expansion of the stabilizer blades. Reduction of drill string pressure to a sufficiently low level will cause upward movement of the expander sleeve and the stabilizer blades are then retracted by springs.

A principal object of the invention is to provide a drill string stabilizer apparatus which may be controlled from the surface. Another object of the invention is to provide such an apparatus which may be expanded and retracted by alteration of internal drill string pressures. Another object of the invention is to provide such apparatus wherein control of the apparatus is achieved through changes in drill string pressures controlled entirely at the surface. Yet another object of the invention is to provide such apparatus wherein downward movement of a member causes stabilizer blade expansion, and upward movement of said member causes stabilizer blade retraction. A still further object of the invention is to provide such an apparatus wherein an increase in drill string internal pressure causes closing of a valve and further increased or continued elevated drill string pressure causes downward movement of the stabilizer actuating member. Yet another object of the invention is to provide such an apparatus which is dependable, economical, and easily operated.

Other objects and advantages of the invention will appear from the following detailed description of a preferred embodiment, reference being made to the accompanying drawings.

BRIEF DESCRIPTIONS OF THE DRAWINGS

FIGS. 1A–1F are axial cross sectional views of a preferred form of apparatus according to the invention showing successive length portions of the apparatus from top to bottom.

Figure 1A:
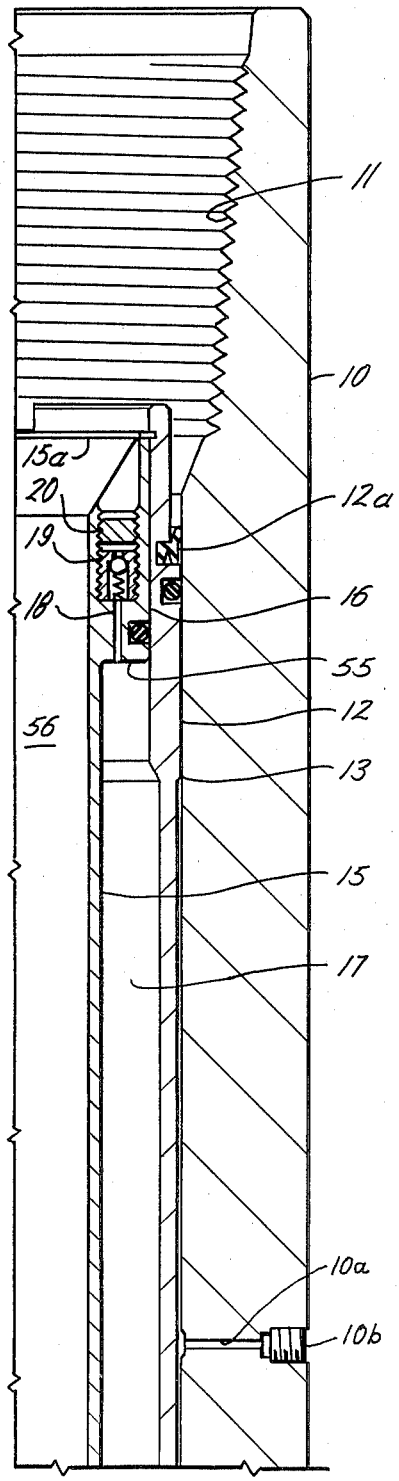
Figure 1B:
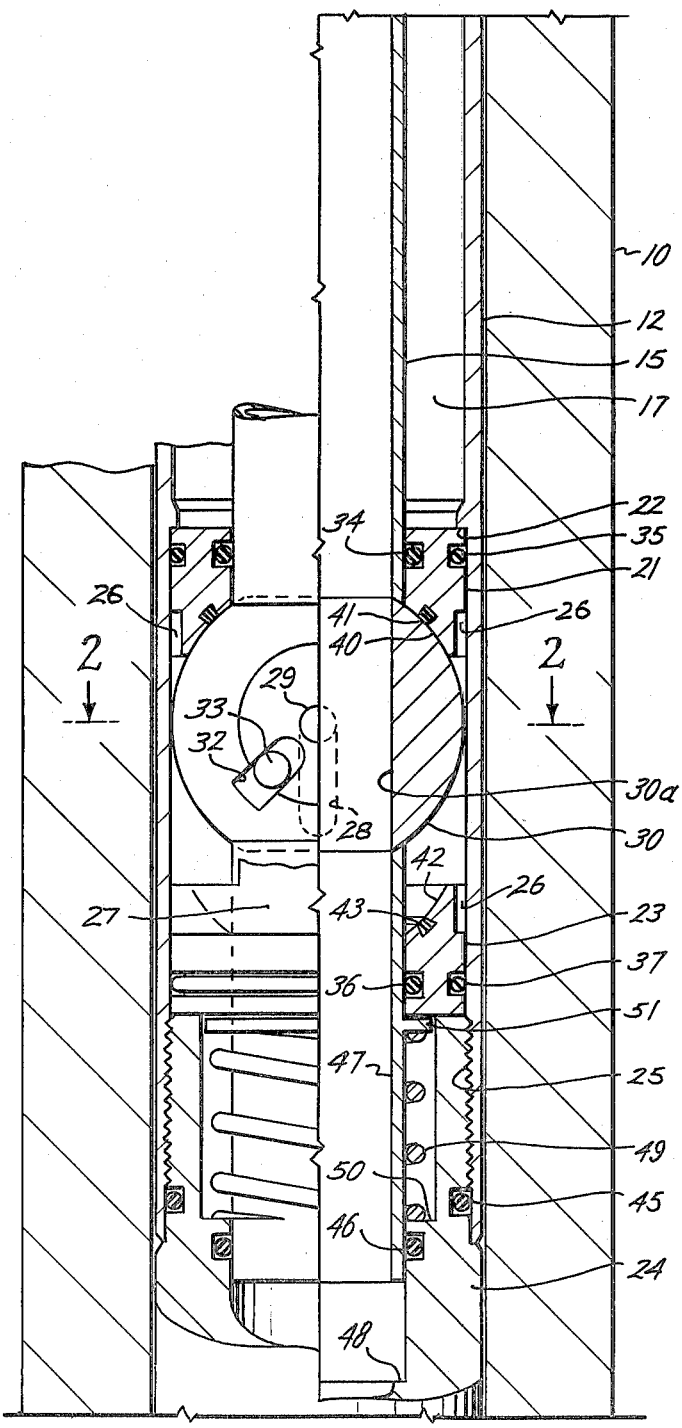
Figure 1E:
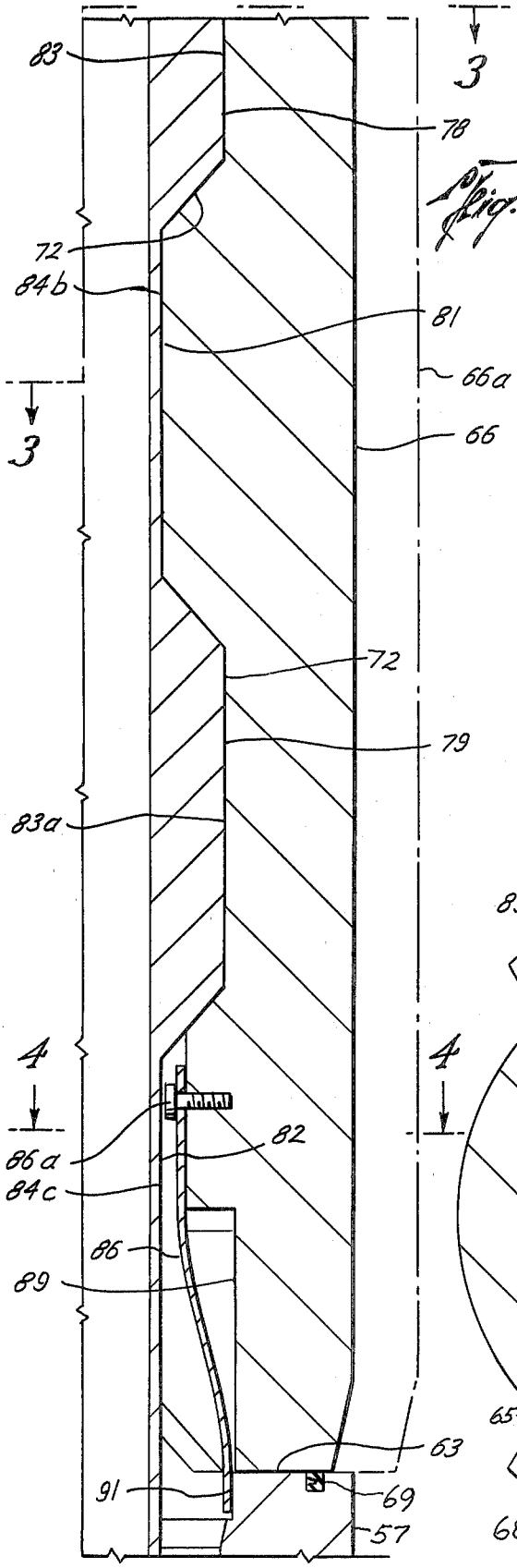
Figure 1F:
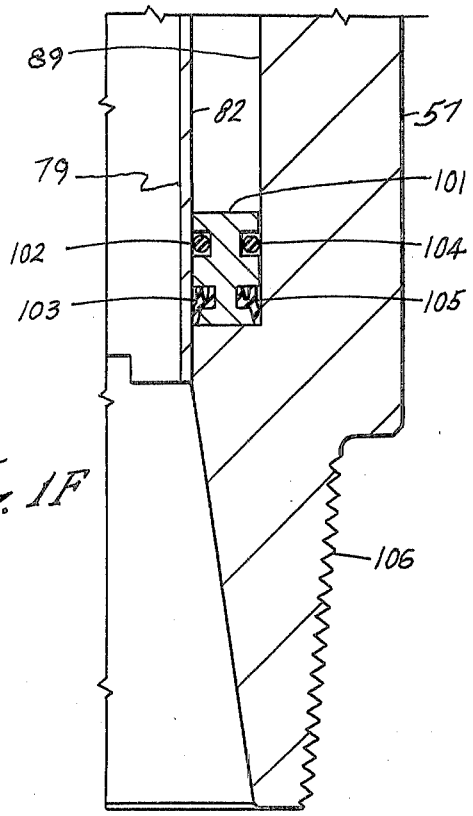
Figure 4:
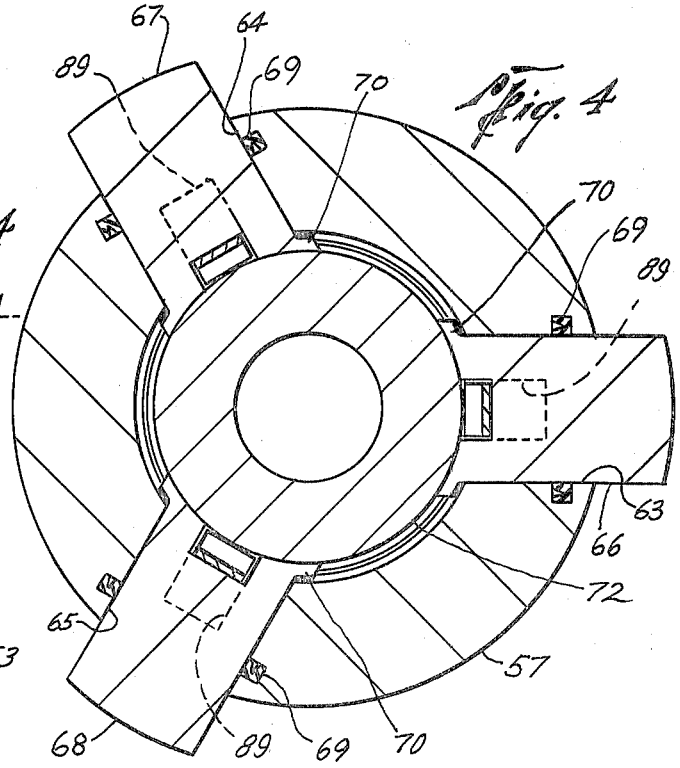
Figure 3:
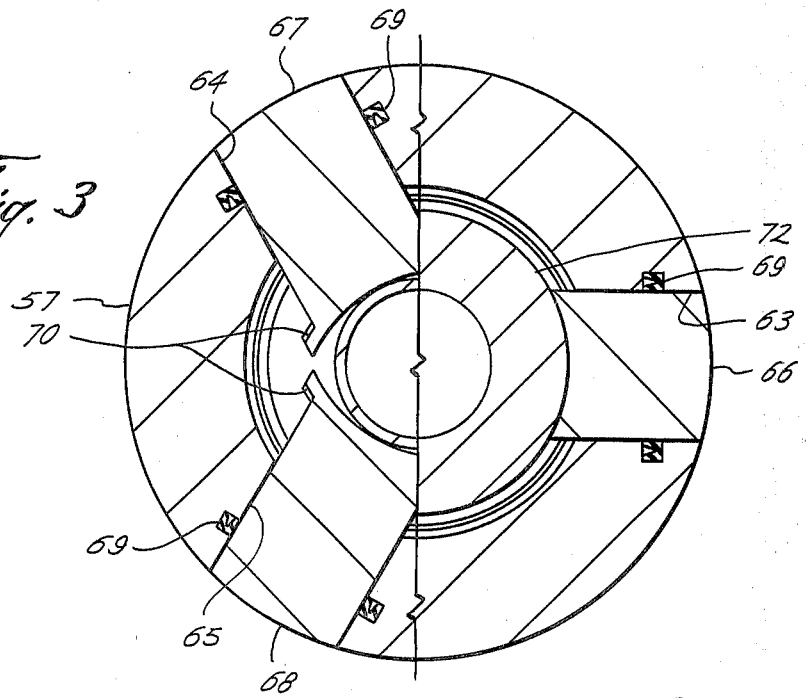

FIGS. 3 and 4 are transverse horizontal cross sections taken at lines 3—3 and 4—4 of FIG. 1E, respectively.

Figure 5:
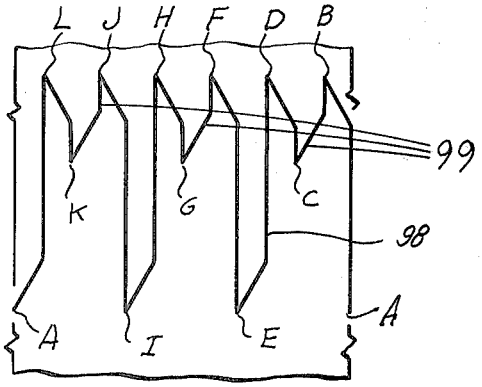

FIG. 5 is a schematic "rolled out" drawing showing the pattern of a barrel cam groove employed in operation of the apparatus.

DESCRIPTION OF THE PREFERRED EMBODIMENT

Describing now the preferred embodiment of apparatus according to the invention which is shown in the drawings, and referring first to FIGS. 1A–1F, the apparatus includes an upper tubular body portion 10 which has an upper threaded socket 11 for screwing onto a threaded pin at the lower end of an upper drill string section extending from the surface. A tubular sleeve 12 lines the upper portion of body member 10, being outwardly enlarged at 13 whereby clearance is provided around sleeve 12 within member 10 below portion 13. An accumulator sleeve 15 is outwardly enlarged at 16 to fit closely within sleeve 12 and to provide an accumulator space 17 therebelow. Outwardly enlarged portion 16 has one or more ports 18 downwardly therethrough enlarged and threaded upwardly to receive a screwed in check valve 19 and a threaded closure plug 20. Sleeve 15 is held down by a Spirolox snap ring **15*a* disposed in an interior groove around the upper end of sleeve 12. Wiper ring assembly 12*a* mounted in an annular groove on sleeve 12 isolates the annular space between body portion 10 and sleeve 12** from well fluids.

Figure 2:
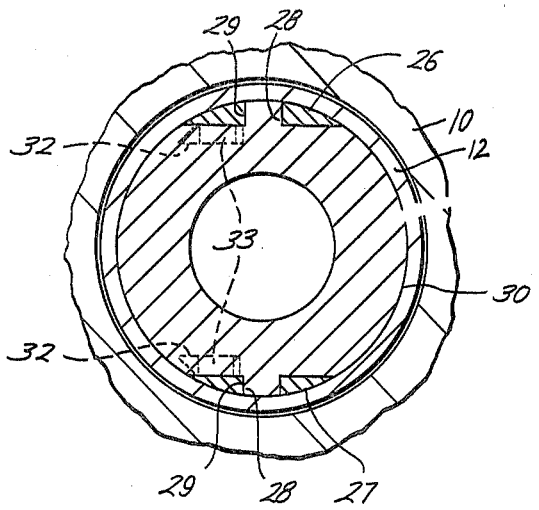
FIG. 2 is a partial transverse horizontal cross section taken at line 2—2 of FIG. 1B.

Ring shaped seat member 21 bears upwardly against interior downwardly facing shoulder 22 of sleeve 12. Ring shaped seat member 23 bears downwardly against the upper end of member 24 which is screwed into interior threads 25 at the lower end of sleeve 12. Seat members 21, 23 are spacedly joined together by longitudinal elements 26–27 in diametrically opposite positions (see FIG. 2). Members 26, 27 are arcuately flat at their inner surfaces and are cylindrical at their outer surfaces to fit within sleeve 12. Each plate portion 26, 27 has an arcuate ended slot 28 therethrough, centered vertically and horizontally, into which a cylindrical pin 29 of a valve ball 30 is received. The two pins 29 are diametrically opposite on ball 30 and the ball may rotate therearound. Adjacent each pin 29, ball 30 has an elongate angular slot 32 within which a pin 33 carried by each bar 26, 27 is disposed.

O-ring seals 34, 35 are provided in surrounding grooves inwardly and outwardly, respectively, of seat portion 21. O-ring seals 36, 37 are provided in surrounding grooves of seat member 23 inwardly and outwardly thereof, as shown, respectively. Spherically shaped seat surface 40 at the bottom side of seat member 21 has a surrounding seal 41 in a suitable groove therearound. Spherically shaped seat surface 42 at the upper end of seat member 23 has a circular seal 43 in a suitable groove therearound. A circular O-ring seal 45 is provided in a groove around member 24 to seal with the lower end of sleeve 12, and a circular O-ring seal 46 at the interior of member 24 seals with the lower end of a sleeve 47. The lower end of sleeve 15 engages the upper side of ball 30 and the upper end of sleeve 47 engages the lower side of ball 30. A helical compression spring 49 is engaged at its lower end with upwardly facing shoulder 50 of member 24 and is engaged at its upper end with integral collar 51 around sleeve 47.

With threaded plug 20 removed, accumulator space 17 may be filled with a fluid such as gaseous nitrogen to a predetermined pressure, check valve 19 preventing escape of the pressured gas from the accumulator space. The accumulator pressure is preferably slightly higher than normal drilling fluid pressure during drilling. After the accumulator space has been filled to the desired pressure, threaded plug 20 may be reinstalled to further insure against escape of pressure from the accumulator space 17. It should be recalled that one or a plurality of the check valve filler ports may be provided. The pressure within accumulator space 17 acts upwardly against downwardly facing shoulder 55 of sleeve 15. When the drilling fluid pressure within the drill string above the apparatus is increased to overcome the accumulator pressure, the pressure is similarly increased within passage 56 of sleeve 15. The increased drilling fluid pressure forces sleeve 15 downwardly, as a piston, acting on its upper surfaces, and sleeve 15 bearing at its lower end against ball 30 moves ball 30 downwardly against the pressure of compression spring 49. As ball 30 moves downwardly to against seat surface 42, it rotates about pins 29 at its opposite sides, and pins 33 acting in grooves 32 cause ball rotation of 90° so that the ball through-port **30*a* is rotated to a position transverse to passage 56 and the ball valve is then in closed position. Upon sufficient reduction of drill string pressure, spring 49 will force sleeve 47 upwardly and return ball 30 to its original open position. Ball valve 30** may thus be opened and closed at will by alteration of drill string fluid pressures.

Port **10*a*, closed by screwed-in plug 10*b*, permits injection of lubricating oil to around sleeve 12, to lubricate the barrel cam around sleeve member 24**, to be described later.

A short sleeve member 57 is screwed at its upper socket 58 to threaded pin 59 forming the lower end of member 10. Member 24 has a downwardly facing shoulder 60 against which the upper end of helical compression spring 61 is disposed, the lower end of spring 61 being engaged against an upwardly facing shoulder 62 at the lower end of the interior of member 10. Member 57 may be referred to as the stabilizer support body. Body 57 has three equally circularly spaced elongate slots 63, 64, 65 within which are respectively disposed stabilizer blades 66, 67, 68. A seal 69 disposed in a groove around each slot 63, 64,65 forms a seal between each stabilizer blade 66–68 and the slot within which it is disposed. Each blade 66–68 has at its inner side edge flanges 70 which prevent passage of the blades out of their respective slots. The outer surface of each blade 66–68 is of a curvature corresponding to the outward form of member 57 and the inner surface of each stabilizer blade is convex, of the curvature of the inner diameter of member 57. A stabilizer actuating sleeve 72 is screwed at interior threads 73 thereof to exterior threads 74 around the lower end of sleeve 24, as shown. An O-ring seal 75 surrounds the upper interior of member 72 to seal with sleeve 24. Sleeve 72 has three peripheral outwardly annularly protruding lands 77–79 therearound alternate to which are disposed reduced diameter portions 80, 81, 82, reduced diameter portion 82 extending to the lower end of sleeve 72. Blades 66–68 each has inwardly relieved vertical areas **83, 83*a* which coincide in shape with lands 78, 79 of sleeve 72 and are disposed thereover, as shown, and has inwardly thickened lands 84*a*, 84*b*, 84*c* adjacent thereto, all of the lands 77–79 and 84*a–c* having angular upper and lower ends to enable mutual sliding movements therebetween. Spring strips 85, 86 are screwed at 85*a*, 86*a*, respectively, to blades 66–68. Blades 66–68 each has a longitudinal interior recess or slot 89 at each of its ends within which the springs 85, 86, curved as shown, are disposed, the upper end of spring 85 being wedged in a recess 90 of member 57 against the outer surface of sleeve 72, and the lower end of spring 86 being disposed in a recess 91 at the upper interior of member 57 just below the lower end of slot 63. The springs 85, 86 bias each stabilizer blade 66–68 toward inwardly moved positions wherein their outer surface, are coincident with the outer surface of member 57. When valve ball 30 is closed as has been described, and sufficiently elevated drill string pressure is applied at the top of ball valve 30, the ball valve and sleeves 24 and 72 are pushed downwardly so that lands 77–79 of sleeve 72 are slidingly moved to beneath lands 84*a*, 84*b*, 84*c*, respectively, of each stabilizer blade. The stabilizer blades are pushed outwardly in slots 63–65 to the outwardly disposed position indicated by dashed line 66*a* of FIGS. 1D and 1E**.

Ring shaped balance piston 101 is slidably disposed around the lower end of sleeve 72 within the inner diameter of member 57. Piston 101 has seals 102, 103 in interior grooves therearound, and has seals 104, 105 in exterior grooves therearound, to seal with members 72, 57, respectively. A threaded pin 106 forms the lower end of member 57, as shown.

Piston 101 moves to balance pressures thereabove and therebelow. When stabilizer blades 63–66 move outwardly, piston 101 may move upwardly to balance the reduced pressure caused by outward blade movement, and vice versa.

When ball valve 30 is opened by relief of pressure within the drill string, then helical coil spring 61 pushes sleeve 24 upwardly moving stabilizer expander sleeve 72 upwardly, and the stabilizer blades 66–68 move inwardly to their original retracted positions. A pin 95 screwed into a tapped opening 96 in the wall of member 10 sealed therearound by O-ring 97, engages at its inner end a barrel cam groove 98 formed in the exterior surface of member 24. The layed-out form of cam groove 98 is indicated in FIG. 5 of the drawings. For each downward and return upward movement of sleeve member 24, member 24 is rotated as indicated by the form of the cam groove. It should be noted that when pin 95 is in shorter portions 99 of groove 98, the sleeves 24 and 72 do not return fully upwardly but are held in relatively lower positions. This serves to maintain the stabilizer blades expanded when drill string pressure is relieved, but on the next increase of drill string pressure sleeves 24 and 72 move fully down and then fully up as indicated by the pattern of groove 98. Therefore, the stabilizer may be held in expanded condition without maintenance of pressure in the drill string above the tool.

Summarizing the operation of the apparatus, starting with the apparatus in retracted condition as shown in the drawings, increased pressure in passage 56 causes ball valve 30 to be closed, and causes sleeves 24 and 72 to be moved downwardly, pin 95 being moved from position A in barrel cam groove 98 to position B in the groove. The lands of sleeve 72 moving beneath the lands of the stabilizer blades forces the stabilizer blades out to their expanded positions shown in FIG. 4. When pressure in passage 56 is sufficiently reduced, valve 30 opens and spring 61 forces sleeves 24 and 72 up and pin 95 moves to position C of groove 98, wherein the blades remain expanded because sleeve 72 is not moved far enough upwardly to move lands 72–79 off of lands 84*a*, 84*b*, 84*c*. When pressure in passage 56 is again increased, valve 30 again closes and sleeves 24, 72 are moved down, pin 95 moving to position D in groove 98, the blades remaining expanded. On the next reduction in passage 56 pressure, pin 95 moves to position E of groove 98, and sleeves 24 and 72 move fully up, the blades 66–69 being retracted. Further alternate increases and decreases in drill string pressure in passage 56 moves pin 95 serially to positions F-L of groove 98, etc., the pin traverse along groove 98 being repeated cyclically for repeated operations of the apparatus. It is clear that the blades may be expanded, held expanded, and retracted, at will, solely by alterations in drilling fluid pressure in the drill string controlled at the surface. No wire line or other tools are required for operation of the apparatus.

While a preferred form of apparatus according to the invention has been described and shown in the drawings, many modifications thereof may be made by a person skilled in the art without departing from the spirit of the invention, and it is intended to protect by Letters Patent all forms of the invention falling within the scope of the following claims.

I claim:

1. Drill string stabilizer apparatus, comprising tubular body means comprising an upper tubular body and a lower tubular body connected end-to-end, said tubular body means having upper and lower connection means for connecting said tubular body means into a drill string, first sleeve means lining said upper tubular body, second sleeve means disposed slidably annularly inward from said first sleeve means forming a pressure accumulator therebetween, said second sleeve means being biased upwardly by pressure within said accumulator and being adapted to be slidably moved downwardly by pressure within said upper tubular body sufficient to overcome said accumulator pressure, valve means adapted to be open when said second sleeve means is in its upward position and to be closed by downward movement of said second sleeve means, said lower tubular body having plural circularly spaced vertical slots having stabilizer blades slidably disposed therethrough and movable radially between expanded and retracted positions therein, actuator sleeve means movable downwardly to expand said stabilizer blades and movable upwardly to permit inward movement of said stabilizer blades, spring means for moving said stabilizer blades inwardly when said actuator sleeve means is moved upwardly, whereby said stabilizer blades are expanded by increase of pressure within said upper tubular body and are retracted upon decrease of pressure within said upper tubular body.

2. The combination of claim 1, including cam groove means on one of said upper tubular body and said actuator sleeve means and pin means engaged therewith on the other of said upper tubular body and said actuator sleeve means for guiding said actuator sleeve means in downward and upward movements.

3. The combination of claim 2, said cam groove means comprising a barrel cam groove on said actuator sleeve means and said pin means being carried by said upper tubular body.

4. The combination of claim 3, said barrel cam groove comprising a continuous groove around said actuator sleeve means permitting said actuator sleeve means to move fully up on alternate upward movements thereof to retract said stabilizer blades and to move only partway up on alternate movements thereof to maintain said stabilizer blades expanded, whereby said stabilizer blades may be kept expanded when pressure within said upper tubular body is reduced.

5. The combination of claim 4, said actuator sleeve means comprising an upper portion having said barrel cam groove thereon, and a lower portion interior of said stabilizer blades.

6. The combination of claim 5, said lower portion of said actuator sleeve having plural axially spaced outwardly protruding annular lands therearound, said stabilizer blades each having axially spaced inwardly protruding lands at their radially inner surfaces, all of said lands having conically tapered surfaces at their upper and lower ends whereby they may be slid axially into engagement to expand said stabilizer blades and out of engagement to retract said stabilizer blades.

7. The combination of claim 6, said stabilizer blade outer surface being flushly aligned with the outer cylindrical surface of said lower tubular body when said stabilizer blades are retracted, whereby said tubular body means has a uniform outer surface when said stabilizer blades are retracted.

8. The combination of claim 1, 2, 3, 4, 5, 6, or 7, said accumulator pressure being provided by nitrogen gas pressured to a pressure somewhat in excess of normal drilling fluid pressure during drilling.

9. The combination of claim 1, 2, 3, 4, 5, 6, or 7, said valve comprising a ball valve rotated between open and closed positions by pin engagements therewith when said second sleeve means is moved downwardly and upwardly.

10. The combination of claim 7, said upper and lower portions of said actuator sleeve means being connected by a thread connection.

11. The combination of claim 10, said spring means for moving said stabilizer blades inwardly comprising a strip spring at each of the upper and lower ends of each said stabilizer blade, each said strip spring being disposed in a recess in the inner side of a said stabilizer blade.

12. The combination of claim 1, 2, 3, 4, 5, 6, 7, 10, or 11, wherein each said stabilizer blade has side flange means at radially inner edges for preventing said stabilizer blades from moving outwardly from said slots.

* * * * *